US005169062A

United States Patent [19]

Baker

[11] Patent Number: 5,169,062

[45] Date of Patent: Dec. 8, 1992

[54] NEWSPAPER DELIVERY TUBE

[75] Inventor: Kenneth Baker, Canfield, Ohio

[73] Assignee: The Steel City Corporation, Youngstown, Ohio

[21] Appl. No.: 825,562

[22] Filed: Jan. 24, 1992

[51] Int. Cl.[5] ..... B65D 91/00

[52] U.S. Cl. ..... 232/1 C; 232/39; 248/225.1; 248/220.2; 403/380; 403/353

[58] Field of Search ..... 232/1 C, 17, 38, 39; 403/353, 380; 248/220.2, 225.1

[56] References Cited

U.S. PATENT DOCUMENTS 3,134,538 5/1964 Tibus .
3,556,393 1/1971 Tibus .
4,100,379 7/1978 Carter et al. ..... 403/380
4,120,446 10/1978 Fuenmeler .
4,724,998 2/1988 Long et al. .
4,951,058 8/1990 Bronson et al. .
5,035,494 7/1991 Foldenauer ..... 403/380

*Primary Examiner*—Renee S. Luebke
*Assistant Examiner*—Michael Milano
*Attorney, Agent, or Firm*—Harpman & Harpman

[57] ABSTRACT

A newspaper delivery tube and mounting bracket for protecting the newspaper from the elements. The newspaper tube has a mounting surface that keys to a mounting bracket without fasteners or tools. The mounting bracket has a vertical leg adapted to be fastened to a post and a horizontal leg that is self-mounted to the delivery tube.

2 Claims, 3 Drawing Sheets

NEWSPAPER DELIVERY TUBE

BACKGROUND OF THE INVENTION

1. Technical Field

This invention relates to newspaper delivery tubes and the like that are used to receive newspapers protecting them from the elements. The delivery tubes are mounted horizontally on a vertically disposed post for use.

2. Description of Prior Art

Prior art devices of this type have relied on a variety of different structural mounting bracket configurations to support a delivery tube horizontally on a vertical post. Such delivery tubes and mounting brackets heretofore have relied on mounting bracket configurations to engage or secure the delivery tube to the bracket, see for example U.S. Pat. Nos. 3,134,538, 3,556,393, 4,120,446, 4,724,998 and 4,951,905.

Referring now to U.S. Pat. No. 3,134,538 a newspaper delivery tube can be seen having a mounting surface and an L-shaped bracket secured thereto by multiple fasteners. The mounting surface has longitudinally extending spaced ribs within a central aperture and oppositely disposed secondary apertures in spaced relation thereto in alignment with the apertures on the mounting bracket.

In U.S. Pat. No. 3,556,393 a newspaper tube with a one-bolt mounting system can be seen wherein a defined mounting configuration is formed on the bottom of the newspaper tube having spaced multiple registering lugs extending therefrom. A matching bracket is aligned by said lugs within the mounting area and a single bolt is used to secure the bracket through a center aperture in the bracket and the tube.

In U.S. Pat. No. 4,120,446 a newspaper delivery receptacle is disclosed having pairs of spaced mounting shoulders formed on the bottom of said tube defining transverse elongated T-shaped channels therein. A mounting bracket is registerable within said channels. A snap fastener boss extends from said receptacle bottom resiliently engaging an aperture in the mounting bracket.

U.S. Pat. No. 4,724,998 is drawn towards a newspaper delivery receptacle having a mounting bracket secured thereto without tools. The tube has a plurality of spaced slots and a central aperture therein. A mounting bracket is registerably positioned within said slots with a raised eye extending through said center aperture. A locking wedge is engaged through said eye within the receptacle locking the bracket thereto.

In U.S. Pat. No. 4,951,905 a mail box support bracket is disclosed that can be used to mount a mail box to a center post or a horizontal support element. The bracket has a pair of cut-out braces that can be depressed forming angular stabilizers for the center post mounting of the box.

SUMMARY OF THE INVENTION

A newspaper delivery tube and mounting bracket has a contoured mounting surface on the bottom of the delivery tube and an interlocking L-shaped mounting bracket for registration therewith. The bracket has horizontally offset mounting tabs that are registerable within multiple spaced engagement apertures within the mounting surface. The bracket configuration can be inserted from either side of the delivery tube for universal mounting requirements.

DESCRIPTION OF THE PREFERRED EMBODIMENT

Figure 1:
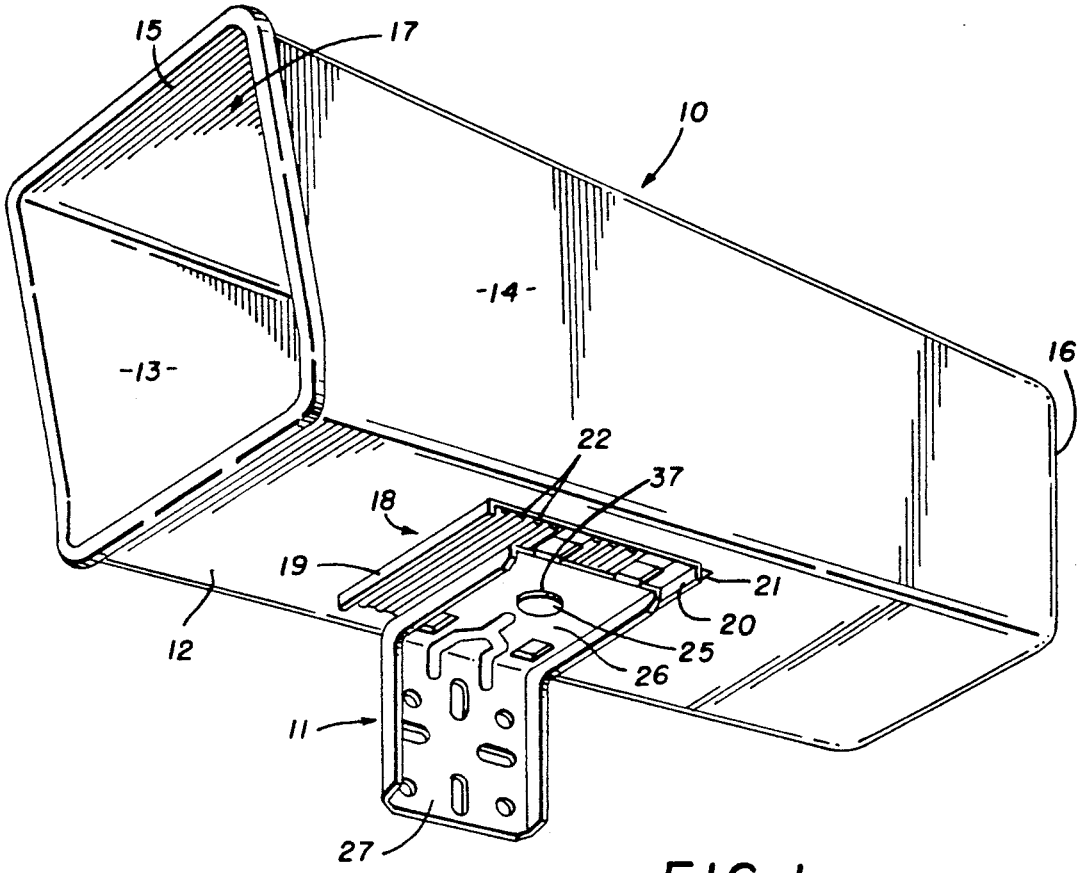
FIG. 1 is a perspective view of the newspaper delivery tube with the mounting bracket attached thereto.
Figure 2:
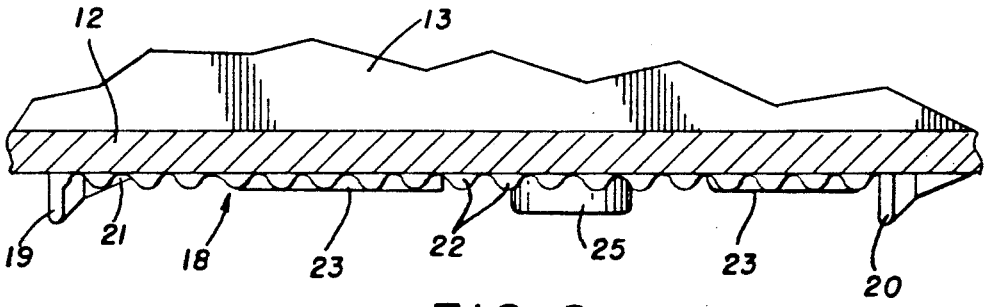
FIG. 2 is an enlarged partial cross-sectional view of the mounting surface on the delivery tube.

A newspaper delivery tube 10 and mounting bracket 11 can be seen in FIG. 1 of the drawings, the tube 10 comprises a bottom 12, sides 13 and 14 and a top 15. The tube is closed on one end at 16 and open at the opposite end at 17. The delivery tube 10 is preferably molded of synthetic resin material.

Figure 3:
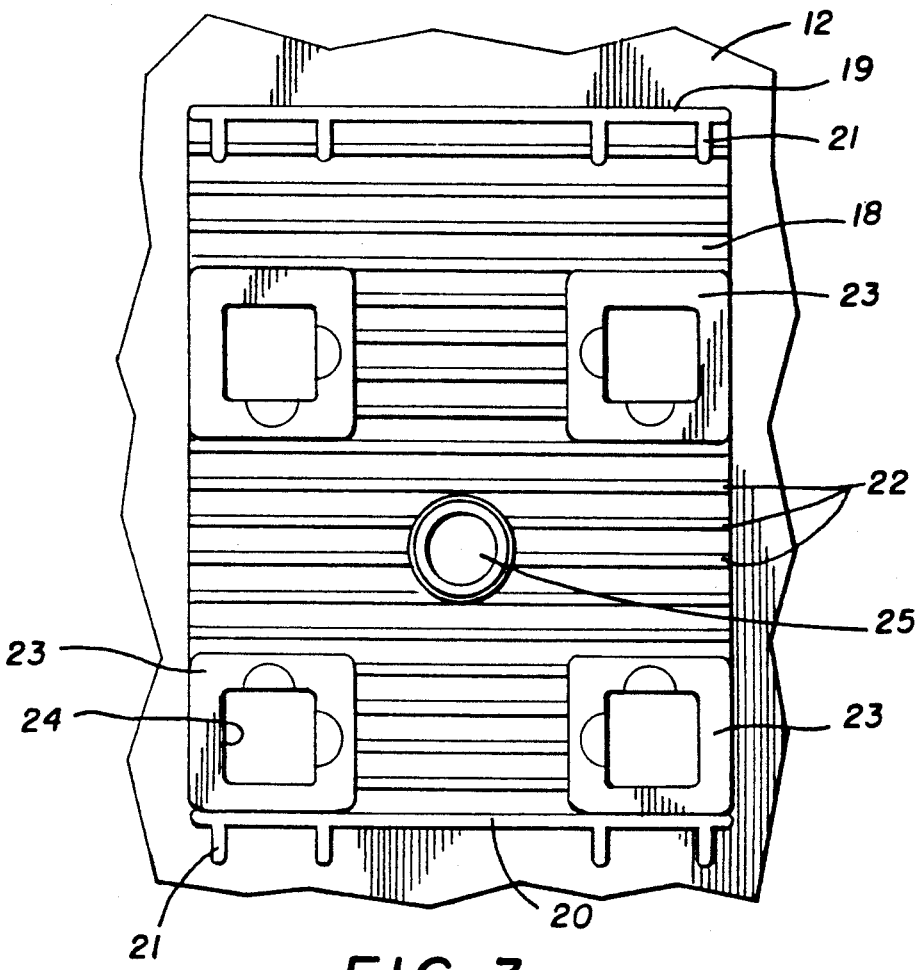
FIG. 3 is an enlarged partial bottom plan view of the mounting surface.

FIG. 1 of the drawings defines the normal mounting alignment when the delivery tube 10 is horizontally positioned on a vertical support element (not shown). The delivery tube 10 has a reinforced mounting area at 18 extending from the bottom 12 as hereinbefore described. The mounting area 18 can best be seen in FIGS. 1 and 3 of the drawings having a pair of oppositely disposed right angularly extending flanges 19 and 20 with support webs 21 extending therefrom. A plurality of parallel ribs extends transversely within said mounting area 18 with pair of spaced raised pads 23 thereon. A generally square aperture at 24 is positioned in each of said respective pads 23 with a center extending circular mounting lug 25 positioned therebetween. It will be seen that the spaced apertures 24 and mounting lug 25 provide all of the critical fastening points within the delivery tube for mounting same.

The mounting bracket 11, best seen in FIGS. 1,4–6 of the drawings has a horizontal first leg 26 and an integral vertical leg 27 extending therefrom. The horizontal leg 26 has a first pair of upstanding locking tabs 28 extending beyond said leg 26. Each of said offset tabs 28 has a central elongated reinforcing element at 29 extending from said tabs to the first leg 26. A second pair of spaced upstanding engagement tabs 30 are formed from said horizontal leg 26 from cut-outs C within as will be well understood by those skilled in the art. Each of these tabs 30 also have center reinforcing elements at 31 as hereinbefore described in tabs 28. Each of the tabs 28 and 30 has an upper and lower surface 28A, 28B and 30A and 30B respectively.

Figure 4:
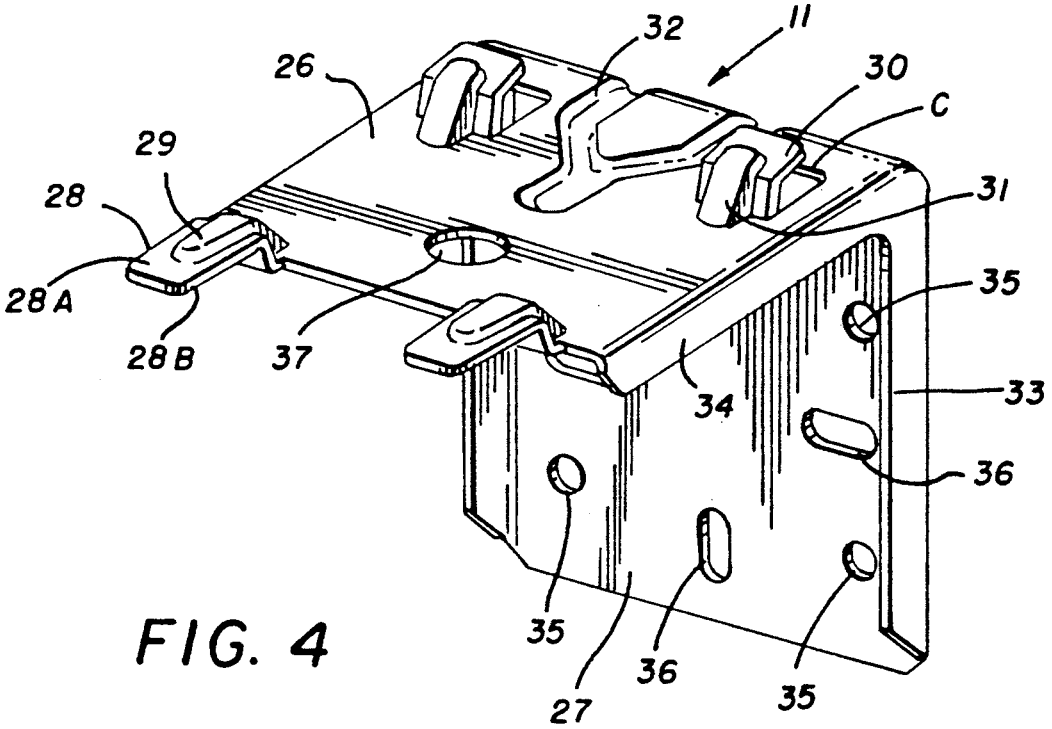
FIG. 4 is a perspective view of the mounting bracket.
Figure 6:
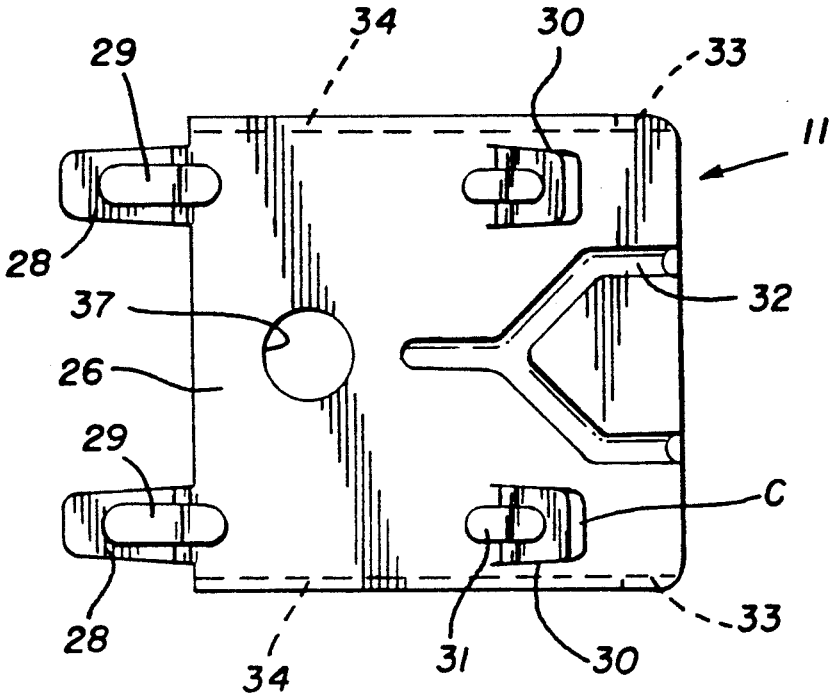
FIG. 6 is a top plan view of the mounting bracket shown in FIGS. 4 and 5 of the drawings.
Figure 5:
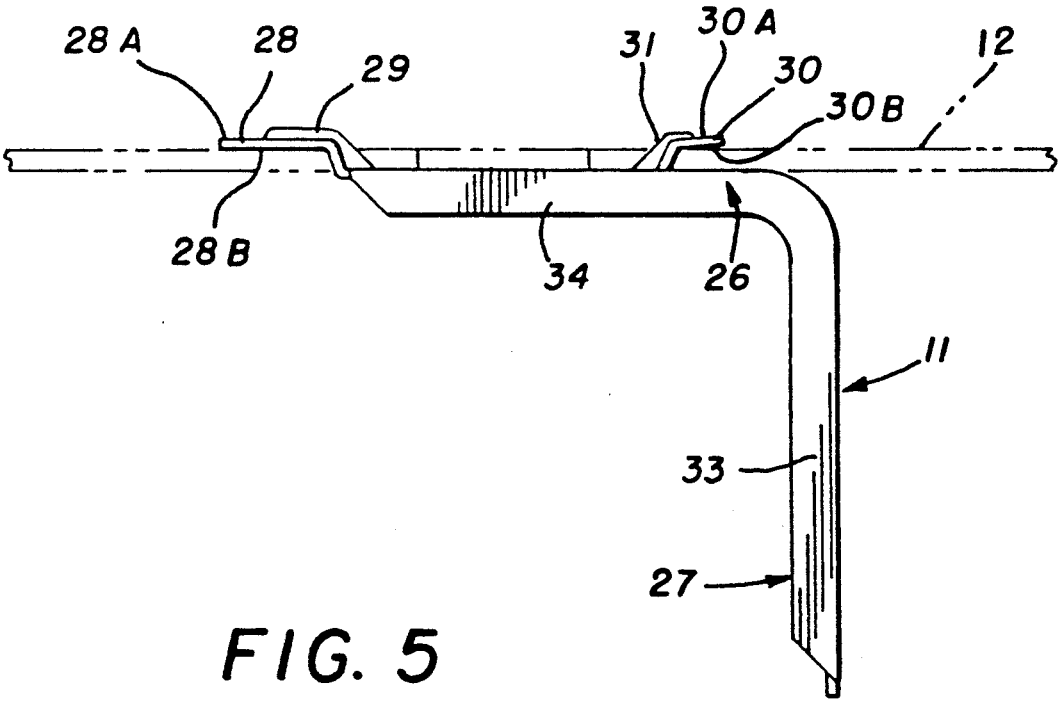
FIG. 5 is a side plan view of the mounting bracket.

The offset nature of said tabs can best be seen in FIGS. 4 and 5 of the drawings wherein the tab pairs 29 and 30 are spaced in parallel aligned relationship to the horizontal plane H of the leg 26. An additional reinforcing element 32 is Y-shaped and is formed between said second pair of tabs 30 and extends to said vertical leg 27. Both said horizontal and vertical legs of the mounting bracket 11 are characterized by right angularly extending side flanges 33 and 34 as seen in FIGS. 1 and 4–6 of the drawings.

The vertical leg 27 has a plurality of mounting apertures within at 35 and 36 with a single circular locking aperture at 37 in said horizontal leg 26.

In use, as best seen in FIG. 1 of the drawings, the mounting bracket's offset tab pairs 28 and 30 are engaged within respective apertures at 24 in the bottom of said delivery tube 10. The bottom surfaces 28B and 30B of each of said respective tabs 28 and 30 engaged the bottom 12 of said delivery tube 10 as seen in broken lines in FIG. 5 of the drawings. The circular mounting lug 25 is first urged upwardly by the engagement with said mounting brackets 11, horizontal leg 26 and then said lug 25 engages and locks within said aperture 37 in the mounting area 18 in a resilient manner as heretofore described.

Given the relative tab position and access to the apertures 24 in the mounting area 18, the mounting bracket 11 can be engaged and locked into the bottom 12 of the newspaper tube 10 from either side providing for adjustable mounting requirement that may be encountered in the field.

It will be apparent from the above description that the vertical leg 27 of the mounting bracket 11 can be fastened to a mounting surface such as a post (not shown) by multiple fasteners engaged through said multiple apertures 35 and 36 therein.

The above described structure provides a simple and fast attachment of the L-shaped mounting bracket 11 to the delivery tube 10 and ensures accurate and dependable positioning of the mounting bracket relative thereto.

Although, but one embodiment of the present invention has been illustrated and described, it will be apparent to those skilled in the art that various changes and modifications may be made therein without departing from the spirit of the invention or from the scope of the applied claims.

Therefore, I claim:

1. An improvement in a newspaper delivery tube and mounting bracket, said delivery tube comprising an elongated tube having a bottom, a first side and a second side, a top and an end wall all integral with one another, said tube has an opening opposite said end and a mounting area on said bottom engageable with said mounting bracket, means for securing said mounting bracket independent of said delivery tube, the improvement comprises, a plurality of spaced parallel ribs within said mounting area, at least one flange extending from said mounting area, a plurality of transversely spaced and longitudinally aligned mounting apertures extending through said tube bottom, said mounting apertures having raised pads thereabout within said mounting area, means for resiliently securing said mounting bracket to said delivery tube, the mounting bracket comprises a first leg and a second leg, paris of upstanding tabs extending from and in parallel spaced relation to said first leg, one of said pairs extending outwardly beyond said first leg, said pairs of upstanding tabs extending in oppositely disposed relation to one another and from said first leg, a central elongated reinforcing element on each of said upstanding tabs and said first and second legs.

2. The improvement in a newspaper deilvery tube and mounting bracket of claim 1 wherein said means for resiliently securing said mounting bracket to said delivery tube comprises a mounting lug within and extending from said mounting area registerable with said first leg of said mounting bracket.

* * * * *